US009343818B2

(12) United States Patent
Chen et al.

(10) Patent No.: US 9,343,818 B2
(45) Date of Patent: May 17, 2016

(54) ANTENNA CONFIGURATIONS FOR WIRELESS SPEAKERS

(75) Inventors: Lee-Yin Vicki Chen, Goleta, CA (US); Shao-Hon Tim Chen, Goleta, CA (US)

(73) Assignee: SONOS, INC., Santa Barbara, CA (US)

( * ) Notice: Subject to any disclaimer, the term of this patent is extended or adjusted under 35 U.S.C. 154(b) by 456 days.

(21) Appl. No.: 13/183,052

(22) Filed: Jul. 14, 2011

(65) Prior Publication Data

US 2013/0016870 A1 Jan. 17, 2013

(51) Int. Cl.

| | |
|---|---|
| ***H04R 25/00*** | (2006.01) |
| ***H01Q 21/28*** | (2006.01) |
| ***H01Q 1/22*** | (2006.01) |
| ***H01Q 9/16*** | (2006.01) |
| ***H01Q 13/10*** | (2006.01) |

(52) U.S. Cl.

CPC ..... *H01Q 21/28* (2013.01); *H01Q 1/22* (2013.01); *H01Q 1/2291* (2013.01); *H01Q 9/16* (2013.01); *H01Q 13/10* (2013.01); *H04R 25/554* (2013.01); *H04R 25/556* (2013.01); *H04R 2420/07* (2013.01)

(58) Field of Classification Search

USPC ..... 381/391, 311, 315; 343/702

See application file for complete search history.

(56) References Cited

U.S. PATENT DOCUMENTS

| | | | | |
|---|---|---|---|---|
| 5,930,376 | A * | 7/1999 | Markow | G06F 1/1616 381/333 |
| 6,531,985 | B1 * | 3/2003 | Jones et al. | 343/702 |
| 6,667,719 | B2 | 12/2003 | LaKomski | |
| 7,925,203 | B2 | 4/2011 | Lane et al. | |
| 8,531,344 | B2 | 9/2013 | Ayatollahi et al. | |
| 8,552,913 | B2 | 10/2013 | Ayatollahi et al. | |
| 2004/0227679 | A1 | 11/2004 | Lu | |
| 2010/0008030 | A1 * | 1/2010 | Weber et al. | 361/679.02 |
| 2010/0125878 | A1 | 5/2010 | Jing et al. | |
| 2010/0321253 | A1 * | 12/2010 | Ayala Vazquez | H01Q 1/2258 343/702 |
| 2010/0321553 | A1 * | 12/2010 | Margolin | 348/333.08 |
| 2011/0050508 | A1 | 3/2011 | Guterman et al. | |
| 2015/0031287 | A1 | 1/2015 | Otsuka et al. | |
| 2015/0091761 | A1 | 4/2015 | van Niekerk | |

OTHER PUBLICATIONS

United States Patent and Trademark Office, "Notice of Allowance," issued in connection with U.S. Appl. No. 14/042,056, filed Jun. 12, 2015, 28 pages.

* cited by examiner

*Primary Examiner* — Amir Etesam

(57) ABSTRACT

Antenna configurations for wireless speakers are disclosed. An example playback device includes a housing having a metallic face and a non-metallic face, the metallic face including an opening; a first antenna of a first type positioned within the housing adjacent an inner surface of the non-metallic face; and a second antenna of second type different from the first type positioned within the housing, the second antenna including a slot aligned with the opening of the metallic face.

12 Claims, 10 Drawing Sheets

ANTENNA CONFIGURATIONS FOR WIRELESS SPEAKERS

FIELD OF THE DISCLOSURE

The disclosure is related to consumer electronics and, more particularly, to antenna configurations for wireless speakers.

BACKGROUND

Technological advancements have increased the accessibility of music content, as well as other types of media, such as television content, movies, and interactive content. For example, a user can access audio, video, or both audio and video content over the Internet through an online store, an Internet radio station, an online music service, an online movie service, and the like, in addition to the more traditional avenues of accessing audio and video content. Demand for such audio and video content continues to surge. Given the high demand, technology used to access and play such content has likewise improved.

BRIEF DESCRIPTION OF THE DRAWINGS

Features, aspects, and advantages of the presently disclosed technology are better understood with regard to the following description, appended claims, and accompanying drawings where:

Figure 1:
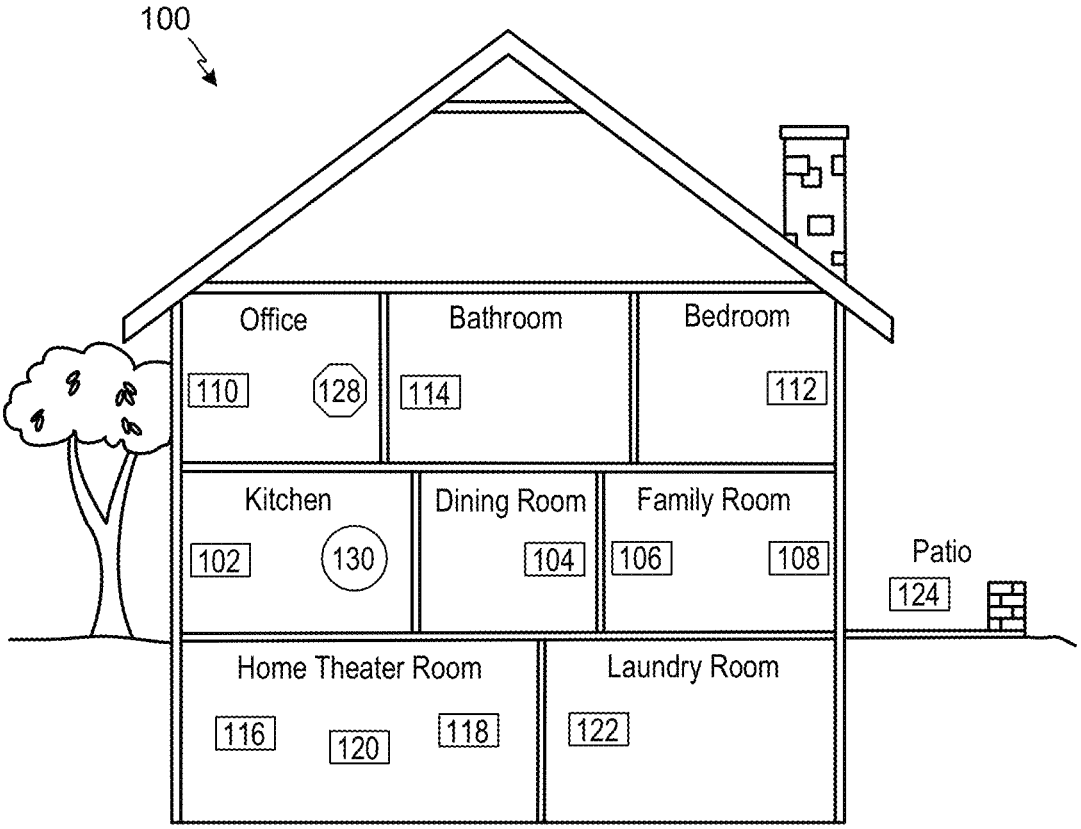
FIG. 1 shows an illustration of an example system in which embodiments of the methods and apparatus disclosed herein may be implemented.

In addition, the drawings are for the purpose of illustrating example embodiments, but it is understood that the present disclosure is not limited to the arrangements and instrumentality shown in the drawings.

DETAILED DESCRIPTION

I. Overview

Media presentation systems include presentation devices, such as displays and/or speakers, to receive content and to generate one or more outputs using the received content. Presentation devices can receive signals representative of the content in a plurality of manners using different techniques and/or technology. In some examples, audio content such as music is encoded onto a carrier signal that is then wirelessly transmitted from one or more sources to one or more wireless playback devices or speakers. A wireless playback device typically includes an antenna to wirelessly receive the signal representative of the audio content. The antenna receives the wireless signal and provides the signal to sound producing equipment capable of processing (e.g., decoding) the signal to generate an audio output corresponding to the transmitted content.

In comparison with wired playback devices, wireless playback devices can be located more freely throughout an environment, such as a house. In such instances, a signal source transmits a wireless signal into the environment and wireless playback devices within range of the signal source receive the wireless signal. Because the placement of a wireless playback device relative to the signal source is unpredictable, wireless playback devices would benefit from an ability to receive the wireless signal from an omni-directional standpoint. That is, it is advantageous for the wireless playback device to be able to receive a wireless signal from any and all directions. To provide such capabilities, some wireless playback devices include more than one antenna. For example, a wireless playback device can include a first antenna oriented to receive a wireless signal from a first direction and a second antenna oriented to receive the wireless signal from a second direction different from the first direction. Therefore, the wireless playback device is more likely to receive the wireless signal in spite of the different locations and/or orientations in which the wireless playback device is placed. Alternatively, some wireless playback devices include one antenna intended to receive the wireless signal from all directions. When the antenna or antennas are unable to receive wireless signal(s) from all directions, maximizing a solid angle that the antenna(s) can transmit, receive, or transmit and received can optimize performance of the playback devices.

Different materials affect a manner or quality in which the antenna(s) transmit, receive, or transmit and receive differently. For example, a metallic portion of a playback device housing affects or interferes with reception of the wireless signal to a first degree or magnitude. A plastic portion of a playback device housing affects or interferes with reception of the wireless signal to a second degree or magnitude different from (typically less than) the first degree or magnitude. The degree or magnitude at which a certain material adversely affects transmission and/or reception of a wireless signal is sometimes referred to herein as an interference factor. For example, differences in materials of the playback device affect an angle at which a wireless signal can be effectively received and/or transmitted by an antenna. The differing interference factors may result from one or more different characteristics of the respective materials such as, for example, capacitance, reflective properties, dielectric properties, etc. If the adverse effect imposed on the reception of the wireless signal by the playback device housing is large enough, the quality of the corresponding output of the presentation device is noticeably (e.g., as perceived by an audience) reduced (e.g., a reduction in range and/or an audio drop out).

Although metallic surfaces have relatively high interference factors (compared to interference factors of plastic surfaces), some playback device housings include metallic faces or grills. For example, wireless speakers sometimes employ metallic grills for purposes of durability and/or aesthetics. In such instances, the metallic grill acts as a reflector of energy associated with internal antenna(s) (e.g., an electric field or E-field of the antenna(s)). That is, the metallic grill prevents energy from radiating in the direction that the metallic grill faces. As a result, the wireless playback device is not omni-directional, as the ability of the wireless playback device to receive wireless signals in at least one direction is limited.

Embodiments of the methods and apparatus disclosed herein provide omni-directional receiving and transmitting capabilities to wireless playback devices having a housing made at least in part of metal and/or some other material having a relatively high interference factor. As described in greater detail below, the methods and apparatus disclosed herein provide an antenna dimensioned and positioned within a housing to align a slot of the antenna with an opening of a high-interference face of the housing. As disclosed herein, the alignment of the slot of the antenna and the opening of the high-interference face enables the playback device to receive wireless signals from a source located in a direction otherwise blocked by the high-interference face of the housing. Moreover, as disclosed herein, the alignment of the slot of the antenna and the opening of the high-interference face enables the playback device to transmit wireless signals in the direction otherwise blocked by the high-interference face of the housing.

Additionally, the methods and apparatus disclosed herein provide covers to be positioned adjacent or within the opening. The covers disclosed herein are made of a material having a lower interference factor than the interference factor of the high-interference face of the housing to reduce interference experienced by the wireless signal while propagating through the opening of the high-interference face. Thus, the antenna configurations and covers disclosed herein transform a signal-blocking face of a playback device into one through which a wireless signal can be received and transmitted without significant adverse effects. Additional and alternative aspects and advantages of the methods and apparatus disclosed herein are described in greater detail below.

An example embodiment of a playback device implemented in accordance with the present disclosure includes a housing having a metallic face and a non-metallic face, the metallic face including an opening. In some embodiments, the playback device also includes a first antenna of a first type positioned within the housing adjacent an inner surface of the non-metallic face. In some embodiments, the playback device also includes a second antenna of second type different from the first type positioned within the housing, the second antenna including a slot aligned with the opening of the metallic face.

In some embodiments, the playback device further includes a non-metallic cover positioned within the opening, and the non-metallic cover has a form factor similar to a form of the opening.

In some embodiments, a center of the non-metallic cover is aligned with a center of the opening.

In some embodiments, the non-metallic cover includes a logo of an entity associated with the playback device.

In some embodiments, the first antenna includes a dipole and the second antenna includes a slot antenna.

In some embodiments, the playback device further includes a third antenna of the first type positioned within the housing adjacent the inner surface of the non-metallic face.

In some embodiments, the playback device further includes audio producing equipment to produce an output directed towards the metallic face of the housing.

In some embodiments, the slot is positioned at a distance from the metallic face of the housing, the distance to maximize a solid angle of a wireless signal traversing through the opening.

In some embodiments, the alignment of the slot and the opening is to maximize a solid angle of a wireless signal traversing through the opening.

An example apparatus implemented in accordance with the present disclosure includes a housing forming an inner cavity, the housing including a first face made from a first material having a first interference factor. In some embodiments, the apparatus also includes a first aperture in the first face positioned to align with a first antenna such that the first antenna is to receive a wireless signal via the first aperture. In some embodiments, the apparatus also includes a cover positioned in the aperture, the cover made from a second material having a second interference factor different from the first interference factor.

In some embodiments, the cover has a form factor substantially similar to a shape of the first aperture.

In some embodiments, each of the first and second interference factors defines a manner in which the respective material interferes with the wireless signal.

In some embodiments, the first and second interference factors indicate that the first material interferes with the wireless signal more than the second material.

In some embodiments, the housing encases audio producing equipment, and an output of the audio producing equipment is directed towards the first face of the housing.

In some embodiments, the first face further includes a plurality of holes each having a lesser diameter than the first aperture.

In some embodiments, the first antenna is to transmit a second wireless signal via the first aperture.

A metallic grill for use in a playback device implemented in accordance with the disclosure includes a plurality of holes each having a first diameter. In some embodiments, the metallic grill also includes an opening having a second diameter greater than the first diameter, the opening being located in the metallic grill such that the opening is aligned with a slot of a slot antenna positioned within a housing of the playback device.

In some embodiments, the metallic grill further includes a non-metallic cover positioned within the opening.

In some embodiments, the non-metallic cover includes a logo associated with the playback device.

In some embodiments, the non-metallic cover is shaped similar to the opening of the metallic grill.

In some embodiments, the metallic grill further includes an attachment mechanism to attach the metallic grill to the housing such that sound producing equipment located within the housing is to produce an audio output directed towards the metallic grill.

In some embodiments, the playback device includes a second antenna of a different type than the slot antenna.

Although the following discloses example methods, apparatus, systems, and articles of manufacture including, among other components, firmware and/or software executed on hardware, it should be noted that such methods, apparatus, systems, and/or articles of manufacture are merely illustrative and should not be considered as limiting. For example, it is contemplated that any or all of these firmware, hardware, and/or software components could be embodied exclusively in hardware, exclusively in software, exclusively in firmware, or in any combination of hardware, software, and/or firmware. Accordingly, while the following describes example methods, apparatus, systems, and/or articles of manufacture, the examples provided are not the only way(s) to implement such methods, apparatus, systems, and/or articles of manufacture.

When any of the appended claims are read to cover a purely software and/or firmware implementation, at least one of the elements in at least one example is hereby expressly defined to include a tangible medium such as a memory, DVD, CD, Blu-ray, etc., storing the software and/or firmware.

These embodiments and many additional embodiments are described more below. Further, the detailed description is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure may be practiced without certain, specific details. In other instances, well known methods, procedures, components, and circuitry have not been described in detail to avoid unnecessarily obscuring aspects of the embodiments.

Reference herein to "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, may be combined with other embodiments.

II. Example Environment

Referring now to the drawings, in which like numerals may refer to like parts throughout the figures. FIG. 1 shows an example system configuration 100 in which one or more of the method and/or apparatus disclosed herein may be practiced or implemented. By way of illustration, the system configuration 100 represents a home with multiple zones. Each zone, for example, represents a different room or space, such as an office, bathroom, bedroom, kitchen, dining room, family room, home theater room, utility or laundry room, and patio. While not shown here, a single zone may cover more than one room or space. One or more of zone players 102-124 are shown in each respective zone. A zone player 102-124, also referred to as a playback device, multimedia unit, speaker, etc., provides audio, video, and/or audiovisual output. A controller 130 (e.g., shown in the kitchen for purposes of illustration) provides control to the system configuration 100. The system configuration 100 illustrates an example whole house audio system, though it is understood that the technology described herein is not limited to its particular place of application or to an expansive system like a whole house audio system 100 of FIG. 1.

Figure 2A:
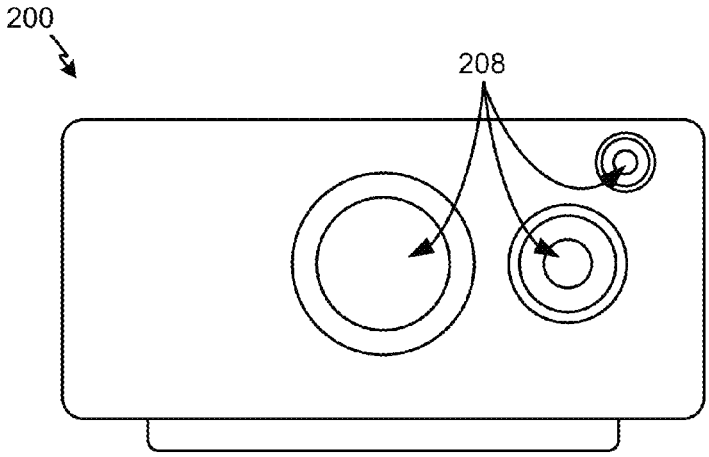
FIG. 2A shows an illustration of an example zone player having a built-in amplifier and speakers.
Figure 2B:
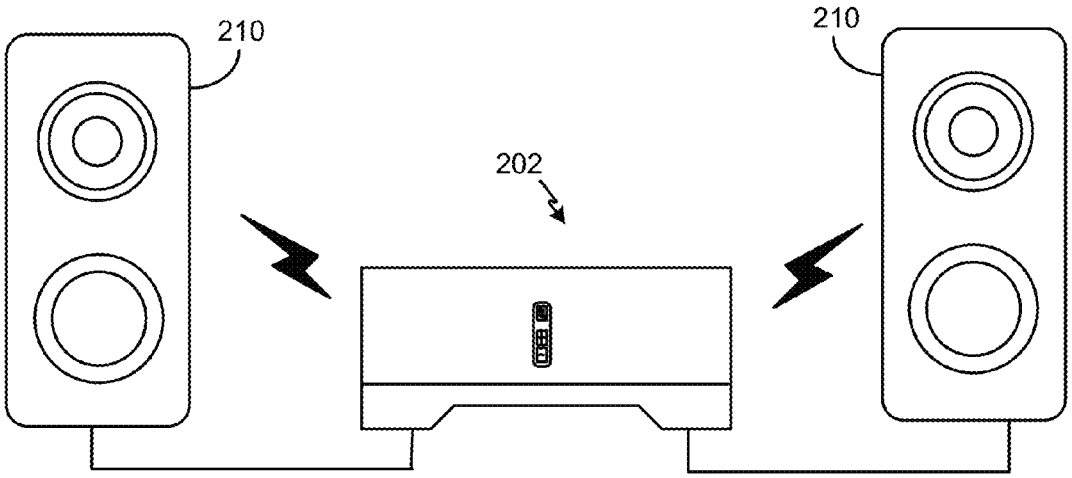
FIG. 2B shows an illustration of an example zone player having a built-in amplifier and connected to external speakers.
Figure 2C:
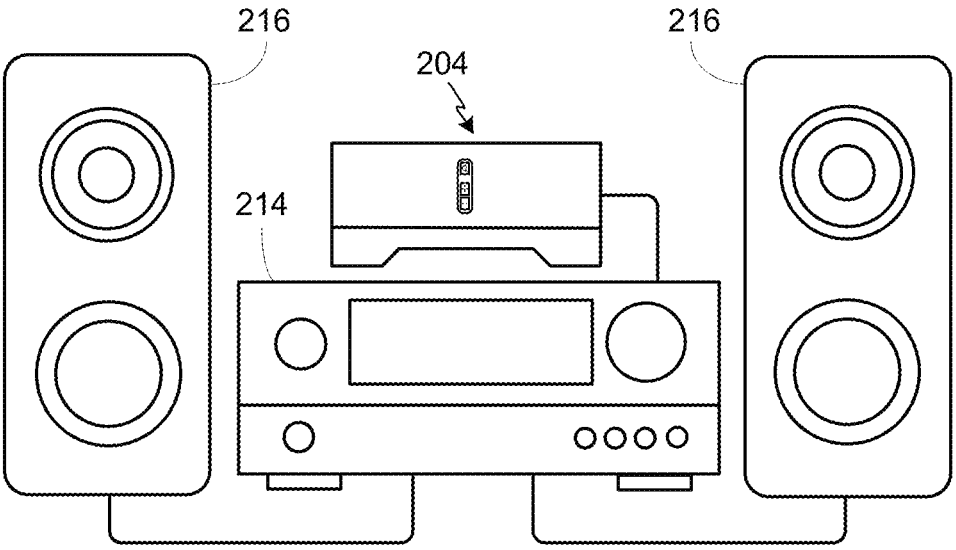
FIG. 2C shows an illustration of an example zone player connected to an A/V receiver and speakers.

FIGS. 2A, 2B, and 2C show example illustrations of zone players 200-204. The zone players 200-204 of FIGS. 2A, 2B, and 2C, respectively, may correspond to any of the zone players 102-124 of FIG. 1. While certain embodiments provide multiple zone players, an audio output may be generated using only a single zone player. FIG. 2A illustrates a zone player 200 including sound producing equipment 208 capable of generating sound or an audio output corresponding to a signal received (e.g., wirelessly and/or via a wired interface). The sound producing equipment 208 of the zone player 200 of FIG. 2A includes a built-in amplifier (not shown in this illustration) and speakers (e.g., a tweeter, a mid-range driver, and/or a subwoofer. In certain embodiments, the zone player 200 of FIG. 2A may be configured to play stereophonic audio or monaural audio. As described in greater detail below, in some embodiments, the example zone player 200 of FIG. 2A can also transmit a second signal to, for example, other zone player(s) in the same or different zone(s), speaker(s), receiver(s), etc. Transmission of the second signal may be part of, for example, a system in which multiple zone players, speakers, receivers, etc. form a network to, for example, present media content in a synchronization or distributed manner.

The example zone player 202 of FIG. 2B includes a built-in amplifier (not shown in this illustration) to power a set of detached speakers 210. The speakers 210 of FIG. 2B may include, for example, any type of loudspeaker. The zone player 202 of FIG. 2B can communicate a signal corresponding to audio content to the detached speakers 210 via wired and/or wireless channels. Instead of receiving and generating audio content as in FIG. 2A, the zone player 202 of FIG. 2B receives the audio content and transmits the same (e.g., after processing the received signal) to the detached speakers 210. Similar to the example zone player 200 of FIG. 2A, in some embodiments the zone player 202 can transmit a second signal to, for example, other zone player(s) in the same or different zone(s), speaker(s), receiver(s), etc.

The example zone player 204 of FIG. 2C does not include an amplifier, but allows a receiver 214, or another audio and/or video type device with built-in amplification, to connect to a data network 128 of FIG. 1 and to play audio received over the data network 128 via the receiver 214 and a set of detached speakers 216. In addition to the wired couplings shown in FIG. 2C, the detached speakers 216 can receive audio content via a wireless communication channel between the detached speakers 216 and, for example, the zone player 204 and/or the receiver 214. In some embodiments the zone player 202 can transmit a second signal to, for example, other zone player(s) in the same or different zone(s), speaker(s), receiver(s), etc.

Example zone players include a "Sonos® S5," "Sonos Play:5," "ZonePlayer 120," and "ZonePlayer 90," which are offered by Sonos, Inc. of Santa Barbara, Calif. A zone player may also be referred to herein as a playback device, and a zone player is not limited to the particular examples illustrated in FIGS. 2A, 2B, and 2C. For example, a zone player may include a wired or wireless headphone. In another example, a zone player might include a subwoofer. In an example, a zone player may include or interact with a docking station for an Apple iPod™ or similar device. In some embodiments, a zone player may relay one or more signals received from, for example, a first zone player to another playback device. In some embodiments, a zone player may receive a first signal and generate an output corresponding to the first signal and, simultaneously or separately, may receive a second signal and transmit or relay the second signal to another zone player(s), speaker(s), receiver(s), etc. Thus, an example zone player described herein can act as a playback device and, at the same time, operate as a hub in a network of zone players. In such instances, media content corresponding to the first signal may be different from the media content corresponding to the second signal.

Figure 3:
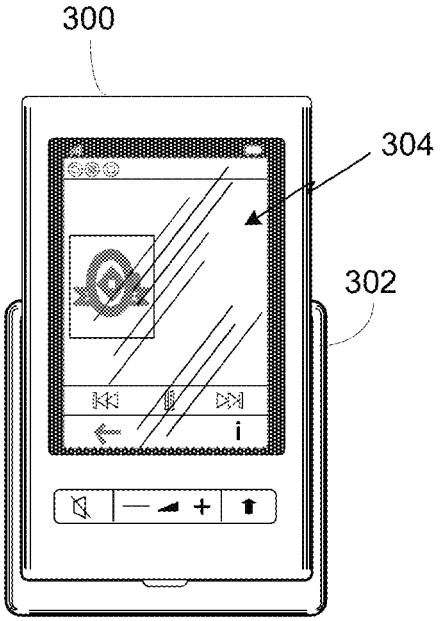
FIG. 3 shows an illustration of an example controller.

FIG. 3 shows an example illustration of a wireless controller 300 in a docking station 302. The controller 300 may correspond to the controlling device 130 of FIG. 1. The controller 300 is provided with a touch screen 304 that allows a user to interact with the controller 300, for example, to retrieve and navigate a playlist of audio items, control operations of one or more zone players, and provide overall control of the system configuration 100. In certain embodiments, any number of controllers may be used to control the system configuration 100. In certain embodiments, there may be a limit on the number of controllers that can control the system configuration 100. The controllers might be wireless like wireless controller 300 or wired to the data network 128. Furthermore, an application running on any network-enabled portable devices, such as an iPhone™, iPad™, Android™ powered phone, or any other smart phone or network-enabled device may be used as a controller by connecting to the data network 128. An application running on a laptop or desktop PC or Mac may also be used as a controller. Example controllers include a "Sonos® Controller 200," "Sonos® Controller for iPhone," "Sonos® Controller for iPad," "Sonos® Controller for Android, "Sonos® Controller for Mac or PC," which are offered by Sonos, Inc. of Santa Barbara, Calif. The flexibility of such an application and its ability to be ported to a new type of portable device is advantageous.

Referring back to the system configuration 100 of FIG. 1, a particular zone may contain one or more zone players. For example, the family room of FIG. 1 contains two zone players 106 and 108, while the kitchen is shown with one zone player 102. Zones may be dynamically configured by positioning a zone player in a room or space and assigning via the controller 130 the zone player to a new or existing zone. As such, zones may be created, combined with another zone, removed, and given a specific name (e.g., "Kitchen"), if so programmed. The zone players 102 to 124 are coupled directly or indirectly to a data network, such as the data network 128 shown in FIG. 1. The data network 128 is represented by an octagon in the figure to stand out from other components shown in the figure. While the data network 128 is shown in a single location, it is understood that such a network may be distributed in and around the system configuration 100.

Particularly, the data network 128 may be a wired network, a wireless network, or a combination of both. In some embodiments, one or more of the zone players 102-124 are wirelessly coupled to the data network 128 based on a proprietary mesh network. In some embodiments, one or more of the zone players 102-124 are wirelessly coupled to the data network 128 using a non-mesh topology. In some embodiments, one or more of the zone players 102-124 are coupled via a wire to the data network 128 using Ethernet or similar technology. In addition to the one or more zone players 102-124 connecting to the data network 128, the data network 128 may further allow access to a wide area network, such as the Internet.

In certain embodiments, the data network 128 may be created by connecting any of the zone players 102-124, or some other connecting device, to a broadband router. Other zone players 102-124 may then be added wired or wirelessly to the data network 128. For example, a zone player (e.g., any of zone players 102-124) may be added to the system configuration 100 by simply pressing a button on the zone player itself, which enables a connection to be made to the data network 128. The broadband router may be connected to an Internet Service Provider (ISP), for example. The broadband router may be used to form another data network within the system configuration 100, which may be used in other applications (e.g., web surfing). The data network 128 may also be used in other applications, if so programmed. Further, in certain embodiments, the data network 128 is the same network used for other applications in the household.

In certain embodiments, each zone can play from the same audio source as another zone or each zone can play from a different audio source. For example, someone can be grilling on the patio and listening to jazz music via zone player 124, while someone is preparing food in the kitchen and listening to classical music via zone player 102. Further, someone can be in the office listening to the same jazz music via zone player 110 that is playing on the patio via zone player 124. In some embodiments, the jazz music played via zone players 110 and 124 is played in synchrony. Synchronizing playback amongst zones allows for someone to pass through zones while seamlessly listening to the audio. Further, zones may be put into a "party mode" such that all associated zones will play audio in synchrony.

In certain embodiments, a zone contains two or more zone players. For example, the family room contains two zone players 106 and 108, and the home theater room contains at least zone players 116, 118, and 120. A zone may be configured to contain as many zone players as desired, and for example, the home theater room might contain additional zone players to play audio from a 5.1 channel or greater audio source (e.g., a movie encoded with 5.1 or greater audio channels). If a zone contains two or more zone players, such as the two zone players 106 and 108 in the family room, then the two zone players 106 and 108 may be configured to play the same audio source in synchrony, or the two zone players 106 and 108 may be paired to play two separate sounds in left and right channels, for example. In other words, the stereo effects of a sound may be reproduced or enhanced through the two zone players 106 and 108, one for the left sound and the other for the right sound. In certain embodiments, paired zone players may play audio in synchrony with other zone players.

In certain embodiments, three or more zone players may be configured to play various channels of audio that is encoded with three channels or more sound. For example, the home theater room shows zone players 116, 118, and 120. If the sound is encoded as 2.1 channel audio, then the zone player 116 may be configured to play left channel audio, the zone player 118 may be configured to play right channel audio, and the zone player 120 may be configured to play bass frequencies. Other configurations are possible and depend on the number of zone players and the type of audio. Further, a particular zone may be configured to play a 5.1 channel audio in one instance, such as when playing audio from a movie, and then dynamically switch to play stereo, such as when playing audio from a two channel source.

In certain embodiments, two or more zone players may be sonically consolidated to form a single, consolidated zone player. A consolidated zone player (though made up of multiple, separate devices) may be configured to process and reproduce sound differently than an unconsolidated zone player or zone players that are paired, because a consolidated zone player will have additional speaker drivers from which sound may be passed. The consolidated zone player may further be paired with a single zone player or yet another consolidated zone player. Each playback device of a consolidated playback device is preferably set in a consolidated mode.

According to some embodiments, one can continue to do any of: group, consolidate, and pair zone players, for example, until a desired configuration is complete. The actions of grouping, consolidation, and pairing are preferably performed through a control interface, such as using controller 130, and not by physically connecting and re-connecting speaker wire, for example, to individual, discrete speakers to create different configurations. As such, certain embodiments described herein provide a more flexible and dynamic platform through which sound reproduction can be offered to the end-user.

Sources of audio content to be played by zone players 102-124 are numerous. Music from a personal library stored on a computer or networked-attached storage (NAS) may be accessed via the data network 128 and played. Internet radio stations, shows, and podcasts may be accessed via the data network 128. Music services that let a user stream and download music and audio content may be accessed via the data network 128. Further, music may be obtained from traditional sources, such as a turntable or CD player, via a line-in connection to a zone player, for example. Audio content may also be accessed through AirPlay™ wireless technology by Apple, Inc., for example. Audio content received from one or more sources may be shared amongst the zone players 102 to 124 via the data network 128 and/or the controller 130.

III. Example Playback Device

Figure 4:
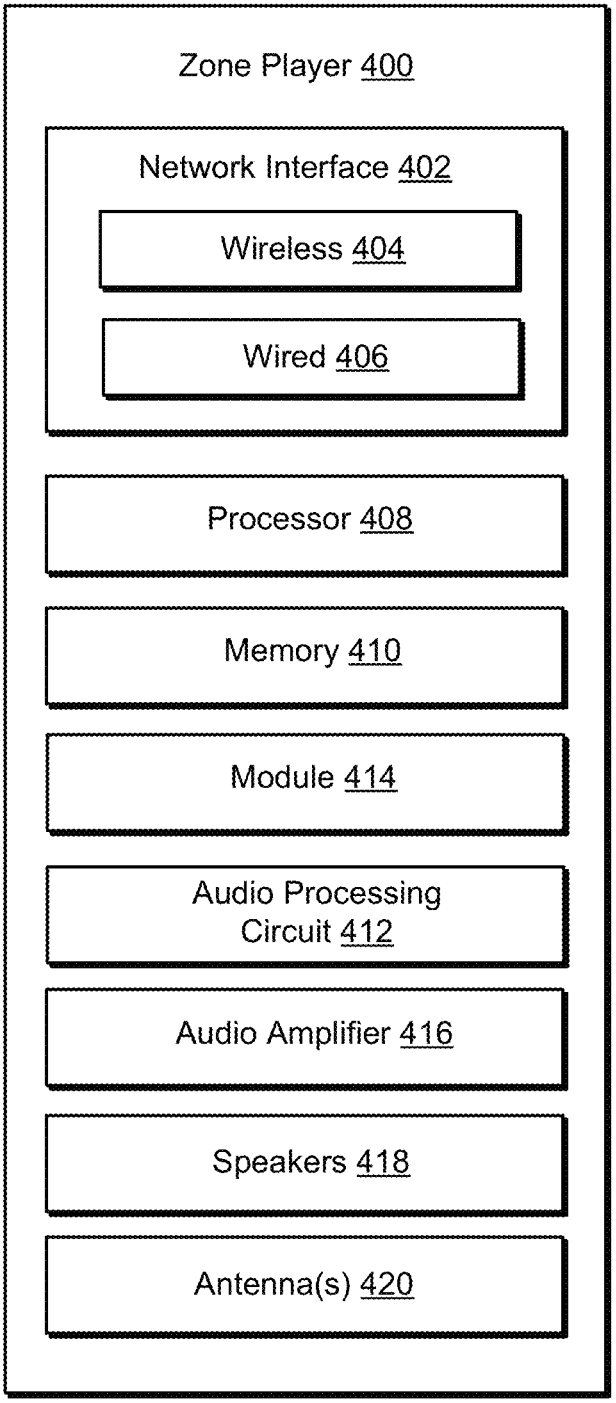
FIG. 4 shows an internal functional block diagram of an example zone player.

Referring now to FIG. 4, there is shown an example functional block diagram of a zone player 400 in accordance with an embodiment. The zone player 400 of FIG. 4 includes a network interface 402, a processor 408, a memory 410, an audio processing component 412, a module 414, an audio amplifier 416, and a speaker unit 418 coupled to the audio amplifier 416. FIG. 2A shows an example illustration of such a zone player. Other types of zone players may not include the speaker unit 418 (e.g., such as shown in FIG. 2B) or the audio amplifier 416 (e.g., such as shown in FIG. 2C). Further, it is contemplated that the zone player 400 may be integrated into another component. For example, the zone player 400 could be constructed as part of a lamp for indoor or outdoor use.

Referring back to FIG. 4, the network interface 402 facilitates a data flow between zone players and other devices on a data network (e.g., the data network 128 of FIG. 1) and the zone player 400. In some embodiments, the network interface 402 may manage the assembling of an audio source or file into smaller packets that are to be transmitted over the data network or reassembles received packets into the original source or file. In some embodiments, the network interface 402 may further handle the address part of each packet so that it gets to the right destination or intercepts packets destined for the zone player 400. Accordingly, in certain embodiments, each of the packets includes an Internet Protocol (IP)-based source address as well as an IP-based destination address.

In some embodiments, the network interface 402 may include one or both of a wireless interface 404 and a wired interface 406. The wireless interface 404, also referred to as an RF interface, provides network interface functions for the zone player 400 to wirelessly communicate with other devices (e.g., other zone player(s), speaker(s), receiver(s), component(s) associated with the data network 128, etc.) in accordance with a communication protocol (e.g., any of the wireless standards IEEE 802.11a, 802.11b, 802.11g, 802.11n, or 802.15). To receive wireless signals and to provide the wireless signals to the wireless interface 404 and to transmit wireless signals, the zone player 400 of FIG. 4 includes one or more antennas 420. The antenna(s) 420 are discussed in greater detail below in connection with FIGS. 6A and 6B. The wired interface 406 provides network interface functions for the zone player 400 to communicate over a wire with other devices in accordance with a communication protocol (e.g., IEEE 802.3). In some embodiments, a zone player includes both of the interfaces 404 and 406. In some embodiments, a zone player 400 includes only the wireless interface 404 or the wired interface 406.

In some embodiments, the processor 408 is a clock-driven electronic device that is configured to process input data according to instructions stored in memory 410. The memory 410 is data storage that may be loaded with one or more software modules 414, which can be executed by the processor 408 to achieve certain tasks. In the illustrated embodiment, the memory 410 is a tangible machine readable medium storing instructions that can be executed by the processor 408. In some embodiments, a task might be for the zone player 400 to retrieve audio data from another zone player or a device on a network. In some embodiments, a task might be for the zone player 400 to send audio data to another zone player or device on a network. In some embodiments, a task might be for the zone player 400 to synchronize playback of audio with one or more additional zone players. In some embodiments, a task might be to pair the zone player 400 with one or more zone players to create a multi-channel audio environment. Additional or alternative tasks may be achieved via the one or more software modules 414 and the processor 408.

The audio processing component 412 may include one or more digital-to-analog converters (DAC), an audio preprocessing component, an audio enhancement component or a digital signal processor, and so on. In certain embodiments, the audio that is retrieved via the network interface 402 is processed and/or intentionally altered by the audio processing component 210. Further, the audio processing component 412 may produce analog audio signals. The processed analog audio signals are then provided to the audio amplifier 416 for play back through speakers 418. In addition, the audio processing component 412 may include necessary circuitry to process analog or digital signals as inputs to play from zone player 400, send to another zone player on a network, or both play and send to another zone player on the network. An example input includes a line-in connection (e.g., an auto-detecting 3.5 mm audio line-in connection).

The audio amplifier 416 is a device that amplifies audio signals to a level for driving one or more speakers 418. The one or more speakers 418 may include an individual transducer (e.g., a "driver") or a complete speaker system that includes an enclosure including one or more drivers. A particular driver may be a subwoofer (for low frequencies), a mid-range driver (middle frequencies), and a tweeter (high frequencies), for example. An enclosure may be sealed or ported, for example.

A zone player 400 may also be referred to herein as a playback device. An example playback device includes a Sonos® S5, which is manufactured by Sonos, Inc. of Santa Barbara, Calif. The S5 is an example zone player with a built-in amplifier and speakers. In particular, the S5 is a five-driver speaker system that includes two tweeters, two mid-range drivers, and one subwoofer. When playing audio content via the S5, the left audio data of a track is sent out of the left tweeter and left mid-range driver, the right audio data of a track is sent out of the right tweeter and the right mid-range driver, and mono bass is sent out of the subwoofer. Further, both mid-range drivers and both tweeters have the same equalization (or substantially the same equalization). That is, they are both sent the same frequencies, just from different channels of audio. Audio from Internet radio stations, online music and video services, downloaded music, analog audio inputs, television, DVD, and so on may be played from a Sonos® S5. While the S5 is an example of a zone player with speakers, it is understood that a zone player with speakers is not limited to one with a certain number of speakers (e.g., five speakers as in the S5), but rather can contain one or more speakers. Further, a zone player may be part of another device, which might even serve a purpose different than audio (e.g., a lamp).

IV. Example Controller

Figure 5:
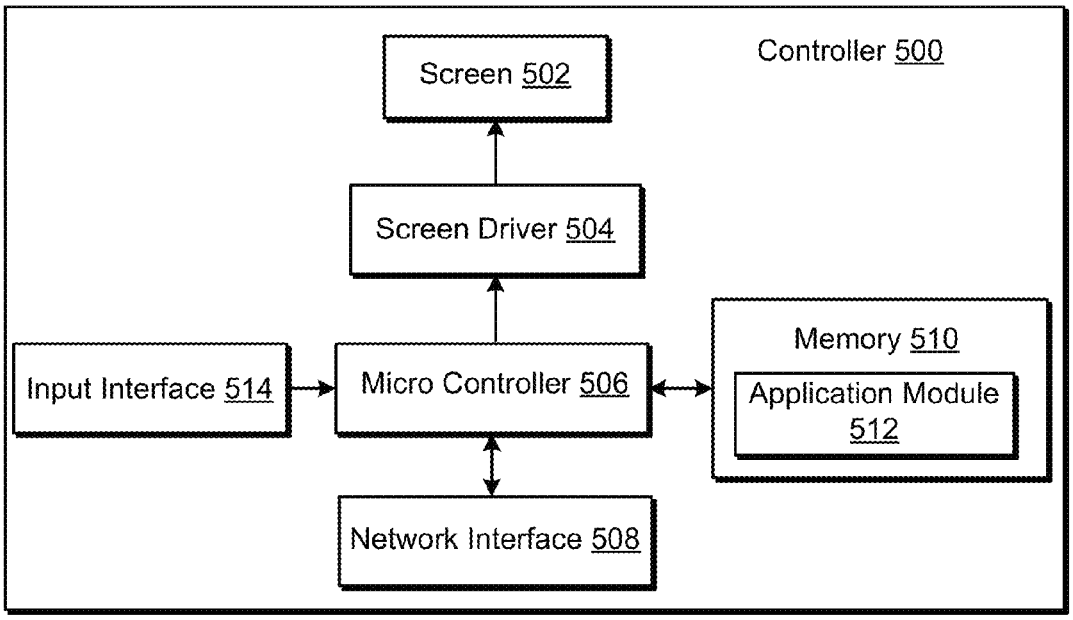
FIG. 5 shows an internal functional block diagram of an example controller.

Referring now to FIG. 5, there is shown an example controller 500, which may correspond to the controlling device 130 in FIG. 1. The controller 500 may be used to facilitate the control of multi-media applications, automation and others in a system. In particular, the controller 500 is configured to facilitate a selection of a plurality of audio sources available on the network and enable control of one or more zone players (e.g., the zone players 102-124 in FIG. 1) through a wireless network interface 508. According to one embodiment, the wireless communications is based on an industry standard (e.g., infrared, radio, wireless standards IEEE 802.11a, 802.11b 802.11g, 802.11n, or 802.15). Further, when a particular audio is being accessed via the controller 500 or being played via a zone player, a picture (e.g., album art) or any other data, associated with the audio source may be transmitted from a zone player or other electronic device to the controller 500 for display.

The controller 500 is provided with a screen 502 and an input interface 514 that allows a user to interact with the controller 500, for example, to navigate a playlist of many multimedia items and to control operations of one or more zone players. The screen 502 on the controller 500 may be an LCD screen, for example. The screen 500 communicates with and is commanded by a screen driver 504 that is controlled by a microcontroller (e.g., a processor) 506. The memory 510 may be loaded with one or more application modules 512 that can be executed by the microcontroller 506 with or without a user input via the user interface 514 to achieve certain tasks. In some embodiments, an application module 512 is configured to facilitate grouping a number of selected zone players into a zone group and synchronizing the zone players for audio play back. In some embodiments, an application module 512 is configured to control the audio sounds (e.g., volume) of the zone players in a zone group. In operation, when the microcontroller 506 executes one or more of the application modules 512, the screen driver 504 generates control signals to drive the screen 502 to display an application specific user interface accordingly.

The controller 500 includes a network interface 508 that facilitates wireless communication with a zone player. In some embodiments, the commands such as volume control and audio playback synchronization are sent via the network interface 508. In some embodiments, a saved zone group configuration is transmitted between a zone player and a controller via the network interface 508. The controller 500 may control one or more zone players, such as 102-124 of FIG. 1. There may be more than one controller for a particular system. Further, a controller may be integrated into a zone player.

It should be noted that other network-enabled devices such as an iPhone®, iPad® or any other smart phone or network-enabled device (e.g., a networked computer such as a PC or Mac® may also be used as a controller) may be used as a controller to interact or control zone players in a particular environment. In some embodiments, a software application or upgrade may be downloaded onto a network enabled device to perform the functions described herein.

In certain embodiments, a user may create a zone group including at least two zone players from the controller 500. The zone players in the zone group may play audio in a synchronized fashion, such that all of the zone players in the zone group play back an identical audio source or a list of identical audio sources in a synchronized manner such that no (or substantially no) audible delays or hiccups could be heard. Similarly, in some embodiments, when a user increases the audio volume of the group from the controller 500, the signals or data of increasing the audio volume for the group are sent to one of the zone players and causes other zone players in the group to be increased together in volume.

A user via the controller 500 may group zone players into a zone group by activating a "Link Zones" or "Add Zone" soft button, or de-grouping a zone group by activating an "Unlink Zones" or "Drop Zone" button. For example, one mechanism for 'joining' zone players together for audio play back is to link a number of zone players together to form a group. To link a number of zone players together, a user may manually link each zone player or room one after the other. For example, assume that there is a multi-zone system that includes the following zones: Bathroom, Bedroom, Den, Dining Room, Family Room, and Foyer.

In certain embodiments, a user can link any number of the six zone players, for example, by starting with a single zone and then manually linking each zone to that zone.

In certain embodiments, a set of zones can be dynamically linked together using a command to create a zone scene or theme (subsequent to first creating the zone scene). For instance, a "Morning" zone scene command may link the Bedroom, Office, and Kitchen zones together in one action. Without this single command, the user would need to manually and individually link each zone. The single command might include a mouse click, a double mouse click, a button press, a gesture, or some other programmed action. Other kinds of zone scenes may be programmed.

In certain embodiments, a zone scene may be triggered based on time (e.g., an alarm clock function). For instance, a zone scene may be set to apply at 8:00 am. The system can link appropriate zones automatically, set specific music to play, and then stop the music after a defined duration. Although any particular zone may be triggered to an "On" or "Off" state based on time, for example, a zone scene enables any zone(s) linked to the scene to play a predefined audio (e.g., a favorable song, a predefined playlist) at a specific time and/or for a specific duration. If, for any reason, the scheduled music failed to be played (e.g., an empty playlist, no connection to a share, failed Universal Plug and Play (UPnP), no Internet connection for an Internet Radio station, etc.), a backup buzzer may be programmed to sound. The buzzer may include a sound file that is stored in a zone player, for example.

V. Providing Omni-Directional Support for Wireless Playback Devices

Figure 6A:
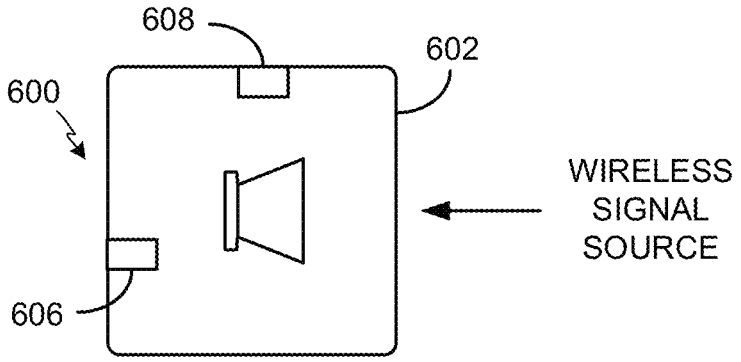
FIG. 6A shows an illustration of a playback device in a first orientation relative to a wireless signal source.
Figure 6B:
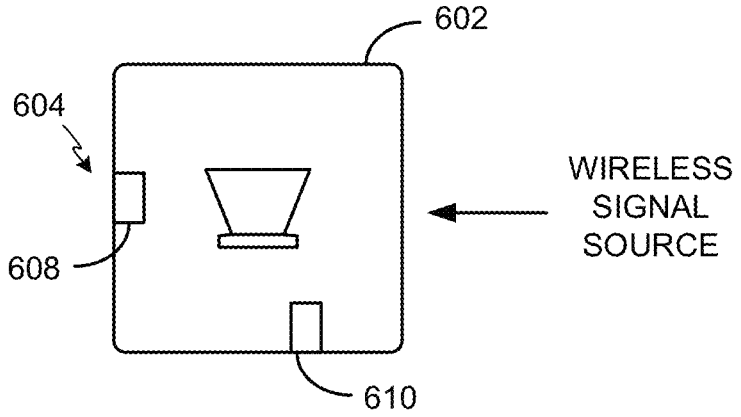
FIG. 6B shows an illustration of the example playback device of FIG. 6A in a second orientation relative to the wireless signal source different from the first orientation of FIG. 6A.

As described above, wireless playback devices benefit from the ability to receive, transmit, or receive and transmit wireless signals to and from any direction at suitable strength and without significant distortion. Such omni-directional support enables users of the wireless playback devices to more freely orient the playback devices relative to a source of the wireless signal. For example, FIG. 6A illustrates the example zone player 200 of FIG. 2A in a first orientation 600 such that a front face 602 of the zone player 200 is pointed towards the source of the wireless signal. FIG. 6B illustrates the example zone player 200 of FIG. 2A in a second orientation 604 such that the front face 602 of the zone player 200 is pointed in a direction other than that from which the wireless signal is sourced. As used herein, the 'front face' of a zone player or speaker refers to the face of the zone player or speaker towards which the sound producing equipment thereof is mainly directed. In the examples of FIGS. 6A and 6B, the sound producing equipment is represented by a speaker having an audio output directed towards the front face 602 of the playback device 200.

The example zone player 200 of FIGS. 6A and 6B includes first and second antennas 606 and 608. While each of the antennas 606-608 may receive a portion of the wireless signal, the position and/or orientation of the first antenna 606 may enable the first antenna 606 to receive the wireless signal in a desirable fashion (e.g., high quality reception) when the signal is received from the direction shown in FIG. 6A. The position and/or orientation of the second antenna 608 may enable the second antenna 608 to receive the wireless signal in a desirable fashion when the signal is received from the direction shown in FIG. 6B. Depending on the type of antenna and the configuration(s) thereof, the first and second antennas 606 and 608 may be alternatively configured to desirably receive wireless signal in different directions. The antennas are often located near or affixed to inner surfaces of a housing 612 of the zone player 200. The example zone player 200 of FIGS. 6A and 6B can include additional or alternative types of antennas located in additional or alternative positions. For example, the zone player 200 may include a single antenna intended to receive, transmit, or receive and transmit the wireless signal from all directions.

When the housing 612 of the zone player 200 is made from materials having low interference factors, such as plastic, the antennas 606-610 can be positioned on or adjacent to any desired inner surface of the housing 612. That is, antennas can be placed on or adjacent to any or all of the faces of the housing 612 without being significantly (e.g., to a degree that would affect a corresponding output of the presentation device) adversely affected by a material having a high interference factor, such as metal.

However, some wireless playback devices include housings that are made, at least in part, with a material having a high interference factor. For example, the zone player 200 of FIG. 2A may have a front face made of metal. In such instances, reception and transmission of the wireless signal at and from the antennas 606-608 of FIGS. 6A and 6B are significantly affected by the metal front face, perhaps to the extent that the zone player 200 would no longer be considered omni-directional. As described above, the metal face reflects energy associated with internal antennas in undesirable directions (e.g., back into the housing 612), thereby reducing the ability of internal antennas to receive or transmit a wireless signal. Further, the metal face can detune the impedance of the wireless signal as the signal is received or transmitted by the internal antennas. The metal face may have additional adverse effects on the wireless signal before and/or during reception, transmission, or reception and transmission of the wireless signal at the internal antennas.

Figure 7:
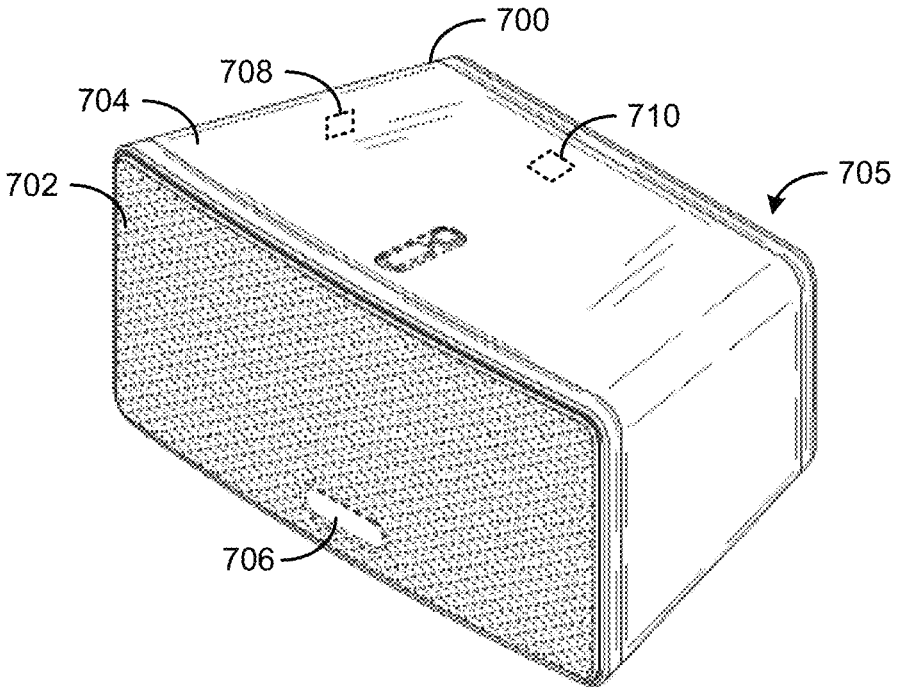
FIG. 7 shows an illustration of an example playback device implemented in accordance with the present disclosure.

FIG. 7 illustrates an example playback device 700 implemented in accordance with the present disclosure. The example playback device 700 of FIG. 7 may correspond to any of the playback devices (e.g., zone players, speakers, etc.) of FIGS. 1-6B. The example playback device 700 of FIG. 7 includes a metallic grill 702 as the front face of a housing 704. The remaining portions or faces 705 of the housing 704 are made from plastic. The playback device 700 may employ the metallic grill 702 for purposes of, for example, durability and/or aesthetics. While the example playback device 700 of FIG. 7 includes a front face made of metal, the present disclosure can be applied to any face of a playback device of any material, including other high-interference materials similar to metal. Further, while the portions or faces 705 of the housing 704 other than the metal grill 702 of the example playback device 700 of FIG. 7 are made from plastic, those portions can be made from any material, including a material having a lower interference factor than the metallic grill 702.

To enable the playback device 700 of FIG. 7 to receive and transmit wireless signals from and to a direction in which the metallic grill 702 faces without significant distortion, thereby enabling the playback device 700 to be omni-directional, the grill 702 includes an opening or aperture 706. The grill 702 may also include a plurality of smaller (in diameter) holes or perforations that form a pattern across the grill 702 that are typical for grills on a front face of a playback device. The opening 706 provides a pathway through which a wireless signal may be received or transmitted by an antenna located inside the housing 704 adjacent and/or affixed to the grill 702. The antenna located inside the housing 704 adjacent and/or affixed to the grill 702 is described below in connection with FIG. 8. The example playback device 700 also includes a plurality of additional antennas 708-710 adjacent and/or affixed to inner surfaces of the plastic faces of the housing 704. Additional or alternative locations and/or orientations of the antennas 708-710 are possible. In the illustrated embodiment of FIG. 7, the antennas 708-710 are dipole antennas capable of receiving and transmitting a wireless signal through the respective plastic face of the housing 704 in accordance with the low interference factor of plastic. That is, the plastic portions of the housing 704 and the relatively low interference factors thereof allow dipole antennas to be used to receive and transmit the wireless signal from, for example, directions in which the plastic portions face. Dipole antennas are typically desirable in application having tight space constraints, such as wireless playback devices. In some embodiments, the antennas 708-710 are not included and the ability of the antenna located inside the housing 704 adjacent and/or affixed to the grill 702 to receive and transmit the wireless signal from any direction (including the direction in which the grill 702 points as the front face of the housing 704).

Figure 8:
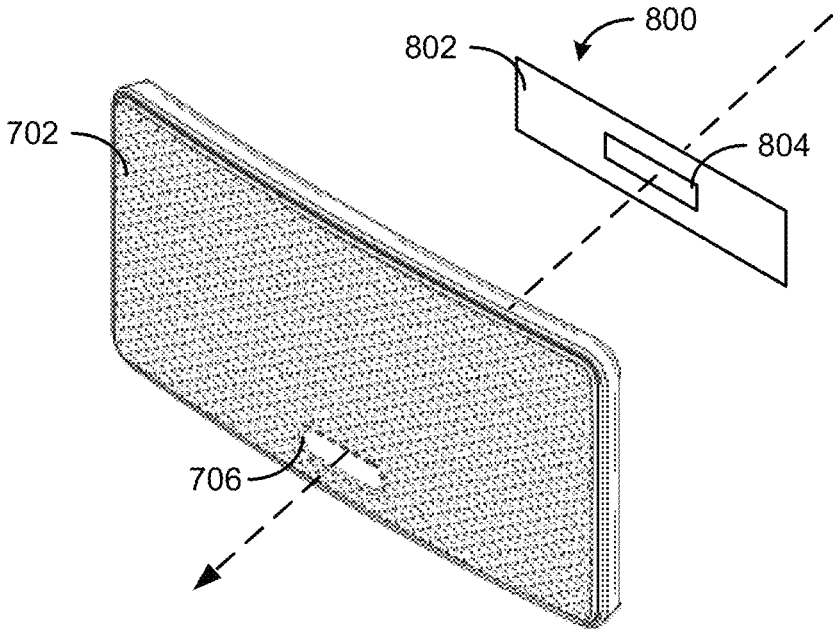
FIG. 8 shows a partially exploded view of the example playback device of FIG. 7.

FIG. 8 shows a partially exploded view of the example playback device 700 of FIG. 7. In particular, FIG. 8 illustrates the antenna 800 located within the housing 704 referenced above in connection with FIG. 7. The example antenna 800 of FIG. 8 is configured and positioned in accordance with the present disclosure to enable an internal component (e.g., an antenna within the housing 704) to receive a wireless signal through the opening 706 of the metal grill 702 and, in some embodiments, to transmit a wireless signal through the opening 706 of the metal grill 702. In the illustrated embodiment of FIG. 8, the antenna 800 is a slot antenna including a ground plane 802 having a slot 804. As shown by the arrow in FIG. 8, a center of the slot 804 (and the ground plane 802) is aligned with a center of the opening 706 in the metal grill 702. When assembled, the playback device 700 includes the antenna 800 located adjacent (e.g., near) an inner surface of the grill 702 and/or affixed to the grill 702 within an inner cavity formed by the housing 704. In particular, the antenna 800 is positioned at a certain distance from the inner surface of the grill 702 such that interference from the metal grill 702 and/or detuning of impedance caused by the metal grill 702 is minimized. This distance can be calculated and implemented using any suitable method, such as a trial and error process, tests, mathematical estimations, etc. As a result, the slot antenna 800 is able to radiate through the opening 706 of the grill 702 to receive, transmit, or receive and transmit wireless signal through the opening 706.

At this location relative to the opening 706, antennas such as dipole antennas, PIFA (Planar Inverted F Antenna) antennas, meander lines, chip antennas, etc., which have E-fields (electric fields) that are parallel with current flow direction, are undesirable for purposes of letting the E-field pass through the opening 706. For example, the direction of current flow for the foregoing types of antennas (e.g., dipole antennas, PIFA antennas, meander lines, chip antennas, etc.) in relation to the opening 706 results in a narrow beam passing through the opening 706, thereby limiting the omni-directional ability of the antenna. In contrast, the E-field radiation of the slot antenna 800 of FIG. 8 does not line up with the current flow thereof.

Figure 9A:
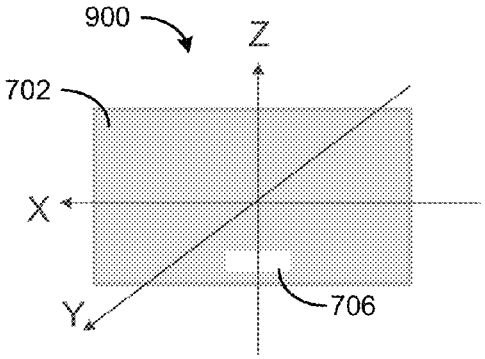
FIGS. 9A-9C show an illustration comparing a dipole antenna to the slot antenna of FIG. 8.
Figure 9B:
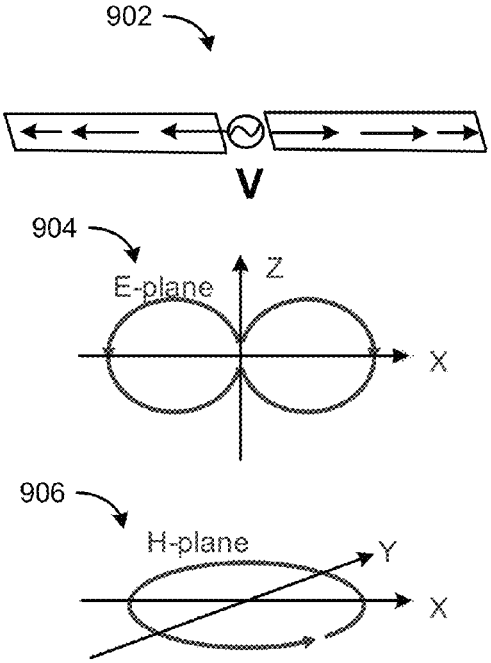
Figure 9C:
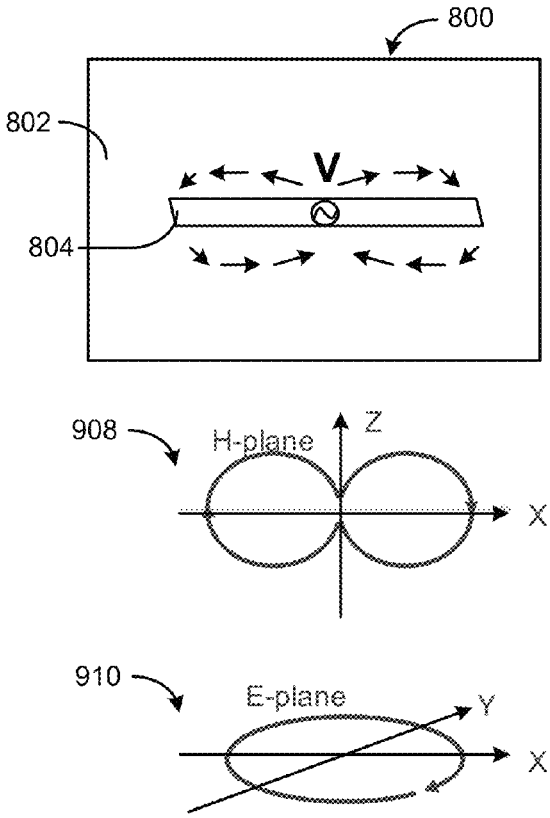

FIGS. 9A-C illustrate a difference between a dipole antenna and the slot antenna 800 of FIG. 8. In particular, FIG. 9A is a legend showing axes to be used in the illustrations of FIGS. 9B and 9C in relation to the example playback device 700 of FIG. 7. The grill 702 of the playback device 700 is shown with the opening 706 positioned near the bottom of the grill 702. As described above in connection with FIG. 8, the slot antenna 800 of FIG. 8 is aligned with the opening 706 along the Y-axis of the legend of FIG. 9A. FIG. 9B shows a dipole antenna 902 with arrows indicative of the direction of the current flow. FIG. 9B also includes an illustration 904 of the E-field radiating from the dipole 902 if the dipole 902 were positioned along the X-axis of the opening 706 shown in FIG. 9A. FIG. 9B also includes an illustration 906 of the magnetic field (H-field) of the dipole 902 if the dipole 902 were positioned along the X-axis of the opening 706 shown in FIG. 9A. On the other hand, FIG. 9C shows the slot antenna 800 of FIG. 8 with arrows indicative of the direction of the current flow. FIG. 9C also includes an illustration 908 of the H-field of the slot antenna 800 when the slot antenna 800 is positioned as shown in FIG. 8 (aligned with the opening 706 of the metal grill 702). FIG. 9C also includes an illustration 910 of the E-field radiating from the slot antenna 800 when the slot antenna 800 is positioned as shown in FIG. 8 (aligned with the opening 706 of the metal grill 702). The slot antenna 800 generates a "magnetic current" inside the slot 804 and, thus, the E-field radiation of the slot antenna 800 does not line up with the current flow. As demonstrated in FIGS. 9A-C, the E-field of the slot antenna 800 radiates through the opening 706 of the metal grill 702. More specifically, because the center of the slot 804 of the antenna 800 is aligned with the center of the opening 706 in the metal grill 702, the E-field radiating from the slot antenna 800 is centered with and radiating through the opening 706. As a result, the slot antenna 800 being positioned as shown in FIG. 8 enables the playback device 700 of FIG. 7 to receive and transmit wireless signals from the direction that the metal grill 702 faces despite the high interference factor of the metal grill 702. In some embodiments, the radiation pattern of the slot antenna 800 is not affected by the distorting characteristics of the metal grill 702 above a certain cut-off frequency. Therefore, the metal grill 702 will not block received or transmitted wireless signal enough to significantly affect the audio output generated by sound-producing equipment located in the playback device 700 or equipment received a wireless signal transmitted by the slot antenna 800.

Using the antenna configurations disclosed above, the playback device 700 can transmit and receive information including audio information, configuration information and control information to and from one or more networked devices. Configuration and control information can be used to enable the playback device 700 to serve as a master or coordinating device, for example. Additionally or alternatively, the configuration and control information can be used to provide multimedia content to one or more devices in the same zone, different zones, or same and different zones as the playback device 700.

Figure 10:
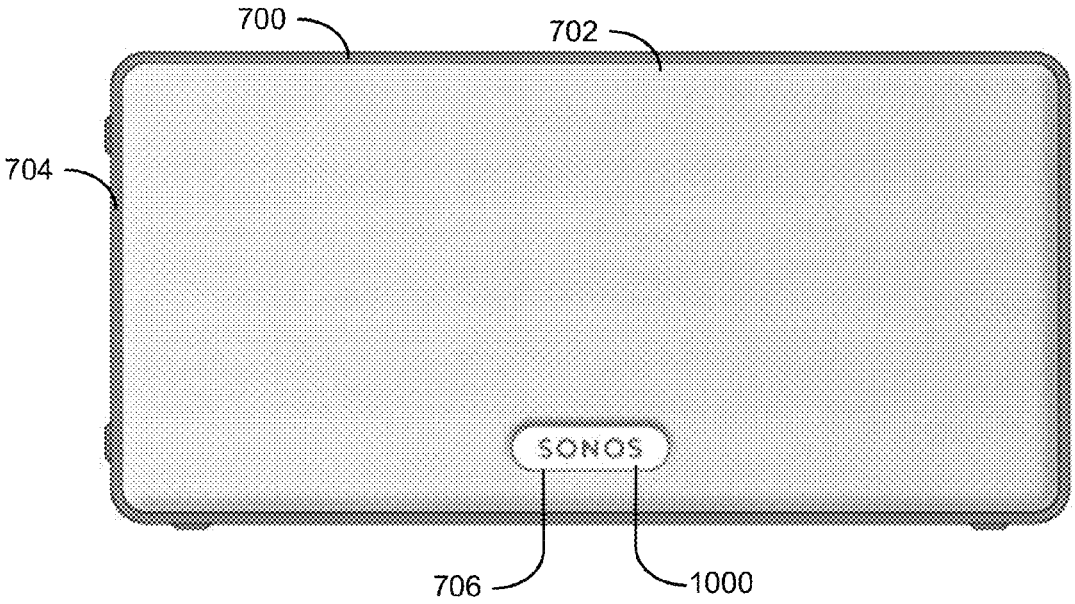
FIG. 10 shows an illustration of a cover for the example playback device of FIG. 7.

FIG. 10 shows a cover 1000 for use with the example playback device 700 of FIG. 7. The example cover 1000 of FIG. 10 is positioned within the opening 706 of the metal grill 702 of the example playback device 700 of FIG. 7. As described above in connection with FIG. 8, the playback device 700 includes the slot antenna 800 positioned with the housing 704 with the slot 804 of the antenna 800 aligned with the opening 706. As described above in connection with FIG. 9, the slot antenna 800 radiates through the opening 706 to avoid the metallic grill 702 and the interference and/or distortion caused thereby. In the illustrated embodiment of FIG. 10, the cover 1000 is made from a material having a low interference factor such that the radiation pattern of the slot antenna 800 through the opening 706 is not significantly affected. In some embodiments, the cover 1000 is made from a plastic having a low interference factor. The cover 1000 can be made from any material and/or composite having a relatively (compared to the metal grill 702) low interference factor to improve the omni-directional ability of the playback device 700.

In some embodiments, the cover 1000 has a form factor substantially similar to a shape of the opening 706. In some embodiments, the cover 1000 is removable coupled to the metallic grill 702 such that an inner cavity of the playback device 700 formed by the housing 704 is accessible via the opening 706 when the cover 1000 is removed. In some embodiments, the cover 1000 is attached to a ridge or shoulder that shapes the opening 706. In such instances, the cover 1000 includes a counterpart ride or shoulder to engage the corresponding portion of the opening 706. In some embodiments, the cover 1000 is press-fitted into the opening 706. In some embodiments, the cover 1000 is fixed into the opening 706 via an adhesive and/or other fastening mechanism(s). In some embodiments, the cover 1000 includes a logo of an entity associated with the playback device 100 (e.g., a manufacturer, designer, and/or provider of the playback device 700 and/or the metallic grill 702).

The cover 1000 disclosed herein covers an otherwise exposed antenna (e.g., the slot antenna 800) by providing a barrier between an inner cavity formed by the housing 706 and an exterior of the playback device 700. The coverage of the opening 706 prevents, for example, a user from being exposed to electrostatic discharge created by the slot antenna 800. The cover 1000 disclosed herein provides such a barrier without significantly interfering with the radiation of energy from the internal antenna(s) of the playback device (e.g., the slot antenna 800). That is, the omni-directional abilities of the playback device 700 provided by the present disclosure is not impeded via the use of the example cover 1000 disclosed herein.

Various inventions have been described in sufficient detail with a certain degree of particularity. It is understood to those skilled in the art that the present disclosure of embodiments has been made by way of examples only and that numerous changes in the arrangement and combination of parts may be resorted without departing from the spirit and scope of the present disclosure as claimed. While the embodiments discussed herein may appear to include some limitations as to the presentation of the information units, in terms of the format and arrangement, the embodiments have applicability well beyond such embodiment, which can be appreciated by those skilled in the art. Accordingly, the scope of the present disclosure is defined by the appended claims rather than the forgoing description of embodiments.

We claim:

1. A playback device comprising:

an enclosed housing having:

a first base on which the playback device rests when oriented in a first direction;

a second base on which the playback device rests when oriented in a second direction;

a metallic face including:

a pattern of holes defined by an outer edge and an inner edge;

an opening defined by the inner edge, the metallic face being a front face of the playback device towards which sound producing equipment is mainly directed; and a first non-metallic face, the non-metallic face being substantially perpendicular with the front face and positioned opposite the first base; and a second non-metallic face, the non-metallic face being substantially perpendicular with the front face, substantially perpendicular to the first non-metallic face, and positioned opposite the second base; and a first antenna of a first type positioned within the housing, the first antenna including a slot aligned with the opening of the front face to produce a first electric field in a first direction extending from the front face and through the opening defined by the inner edge of the pattern of holes;

a second antenna of a second type different from the first type affixed to the first non-metallic face of the housing and positioned within the housing, the second antenna positioned to produce a second electric field in a second direction; and a third antenna of the second type affixed to the second non-metallic face of the housing and positioned within the housing, the third antenna positioned to produce a third electric field in a third direction substantially orthogonal to the second direction.

2. A playback device as defined in claim 1, further comprising a non-metallic cover positioned within the opening, wherein the non-metallic cover has a form factor similar to a form of the opening in the metallic face.

3. A playback device as defined in claim 2, wherein a center of the non-metallic cover is aligned with a center of the opening.

4. A playback device as defined in claim 2, wherein the non-metallic cover comprises a logo of an entity associated with the playback device.

5. A playback device as defined in claim 1, wherein the first and second antenna comprise a dipole.

6. A playback device as defined in claim 1, the alignment of the slot and the opening to maximize a solid angle of a wireless signal traversing through the opening that can be detected by the first antenna.

7. An apparatus, comprising:

a housing forming an inner cavity, the housing including a first base on which the apparatus rests when oriented in a first direction; a second base on which the apparatus rests when oriented in a second direction; a first face made from a first material having a first interference factor; a second face substantially perpendicular to the first face, positioned opposite to the first base, and made from a second material having a second interference factor different than the first interference factor, the first face including a pattern of holes defined by an outer edge and an inner edge; and a third face substantially perpendicular to the first face, substantially perpendicular to the second face, positioned opposite the second base, and made from the second material having the second interference factor different than the first interference factor;

an aperture in the first face positioned to center an electric field radiating in a first direction from a slot of a first antenna with a center of the aperture such that the first antenna is to receive a wireless signal via the electric field, a shape of the aperture being defined by the inner edge of the pattern of holes;

a second antenna affixed to the second face in the inner cavity, the second antenna positioned to radiate in a second direction extending from the second face;

a third antenna affixed to the third face in the inner cavity, the third antenna positioned to radiate in a third direction extending from the third face, wherein the third direction is substantially orthogonal to the second direction; and a cover positioned within the aperture, the cover made from a second material having a second interference factor different from the first interference factor.

8. An apparatus as defined in claim 7, wherein the cover has a form factor substantially similar to the shape of the aperture.

9. An apparatus as defined in claim 7, wherein each of the first and second interference factors defines a manner in which the respective material interferes with the wireless signal.

10. An apparatus as defined in claim 7, wherein the first and second interference factors indicate that the first material interferes with the wireless signal in more than the second material.

11. An apparatus as defined in claim 7, wherein the housing encases audio producing equipment, and wherein an output of the audio producing equipment is mainly directed towards the first face of the housing.

12. An apparatus as defined in claim 7, wherein the respective ones of the holes have a lesser diameter than the aperture, the second face being solid.

* * * * *